US010428771B2

(12) United States Patent
Yamamoto et al.

(10) Patent No.: US 10,428,771 B2
(45) Date of Patent: Oct. 1, 2019

(54) VAPORIZED-FUEL PROCESSING APPARATUS

(71) Applicant: HONDA MOTOR CO., LTD., Tokyo (JP)

(72) Inventors: Mitsunobu Yamamoto, Wako (JP); Kazunori Koura, Wako (JP); Takayuki Namai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 395 days.

(21) Appl. No.: 14/018,424

(22) Filed: Sep. 5, 2013

(65) Prior Publication Data

US 2014/0076287 A1 Mar. 20, 2014

(30) Foreign Application Priority Data

Sep. 14, 2012 (JP) ..... 2012-203350

(51) Int. Cl.
*F02M 25/08* (2006.01)
*F02M 35/10* (2006.01)

(52) U.S. Cl.
CPC ..... *F02M 25/0854* (2013.01); *F02M 25/08* (2013.01); *F02M 35/10222* (2013.01)

(58) Field of Classification Search
CPC .. F02M 25/08; F02M 25/0872; F02M 25/089; F02M 25/0854; F02D 41/003
USPC ..... 123/520, 516, 518, 519
See application file for complete search history.

(56) References Cited

U.S. PATENT DOCUMENTS 4,127,097 A * 11/1978 Takimoto ..... F02M 25/0836 123/520
4,693,226 A * 9/1987 Choma ..... F02M 35/10085 123/568.17
5,636,617 A * 6/1997 Nakatsu ..... F02M 25/0836 123/516
2011/0132310 A1* 6/2011 Born ..... F02M 35/10019 123/184.21

FOREIGN PATENT DOCUMENTS

| | | |
|---|---|---|
| JP | 04-164146 | 6/1992 |
| JP | 04-237860 | 8/1992 |
| JP | 11-200960 | 7/1999 |
| WO | WO 2007/020736 | 2/2007 |

OTHER PUBLICATIONS

Japanese Office Action for corresponding JP Application No. 2012-203350, dated May 19, 2014.

* cited by examiner

*Primary Examiner* — Lindsay M Low
*Assistant Examiner* — Omar Morales
(74) *Attorney, Agent, or Firm* — Mori & Ward, LLP

(57) ABSTRACT

A vaporized-fuel processing apparatus includes an intake passage, a chamber, a first purge guide hole, and a second purge guide hole. The intake passage is defined by an intake manifold and a throttle body. The chamber communicates with the intake passage. The first purge guide hole is to guide vaporized fuel adsorbed in a canister toward the chamber. The second purge guide hole is to guide the vaporized fuel adsorbed in the canister toward the chamber.

19 Claims, 8 Drawing Sheets

26a
ON
OFF
26b
ON
OFF

26a
ON
OFF
26b
ON
OFF

26a
ON
OFF
26b
ON
OFF

26a
ON
OFF
26b
ON
OFF
LOW
REQUESTED FLOW RATE
HIGH

VAPORIZED-FUEL PROCESSING APPARATUS

CROSS-REFERENCE TO RELATED APPLICATIONS

The present application claims priority under 35 U.S.C. § 119 to Japanese Patent Application No. 2012-203350, filed Sep. 14, 2012, entitled "Vaporized Fuel Processing Apparatus." The contents of this application are incorporated herein by reference in their entirety.

BACKGROUND OF THE INVENTION

Field of the Invention

The present disclosure relates to a vaporized-fuel processing apparatus.

Discussion of the Background

For example, a fuel tank for supplying fuel to an internal combustion engine, such as an engine, is known. In this fuel tank, vaporized fuel is produced as a result of vaporization of the fuel, and a canister is provided for preventing the vaporized fuel from spreading to the atmosphere.

The canister is filled with, for example, an adsorbent, such as active carbon, and the vaporized fuel is adsorbed and captured by the adsorbent. When the internal combustion engine is to be driven, the vaporized fuel adsorbed and captured in the canister is introduced to an intake passage of the internal combustion engine via a purge passage. Accordingly, a large amount of vaporized fuel is prevented from being stored in the canister.

For example, Japanese Unexamined Patent Application Publication No. 4-237860 discloses a vaporized-fuel processing apparatus having a first purge port at the upstream side of a throttle valve in the intake passage and a second purge port in a venturi tube disposed at the downstream side of the intake passage. In the vaporized-fuel processing apparatus disclosed in Japanese Unexamined Patent Application Publication No. 4-237860, a pipe connected to the canister is connected to the second purge port, and a communication passage branching off from an intermediate section of this pipe is connected to the first purge port.

SUMMARY OF THE INVENTION

According to one aspect of the present invention, a vaporized-fuel processing apparatus includes an intake passage, a chamber, a first purge guide hole, and a second purge guide hole. The intake passage is defined by an intake manifold and a throttle body. The chamber communicates with the intake passage. The first purge guide hole is to guide vaporized fuel adsorbed in a canister toward the chamber. The second purge guide hole is to guide the vaporized fuel adsorbed in the canister toward the chamber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
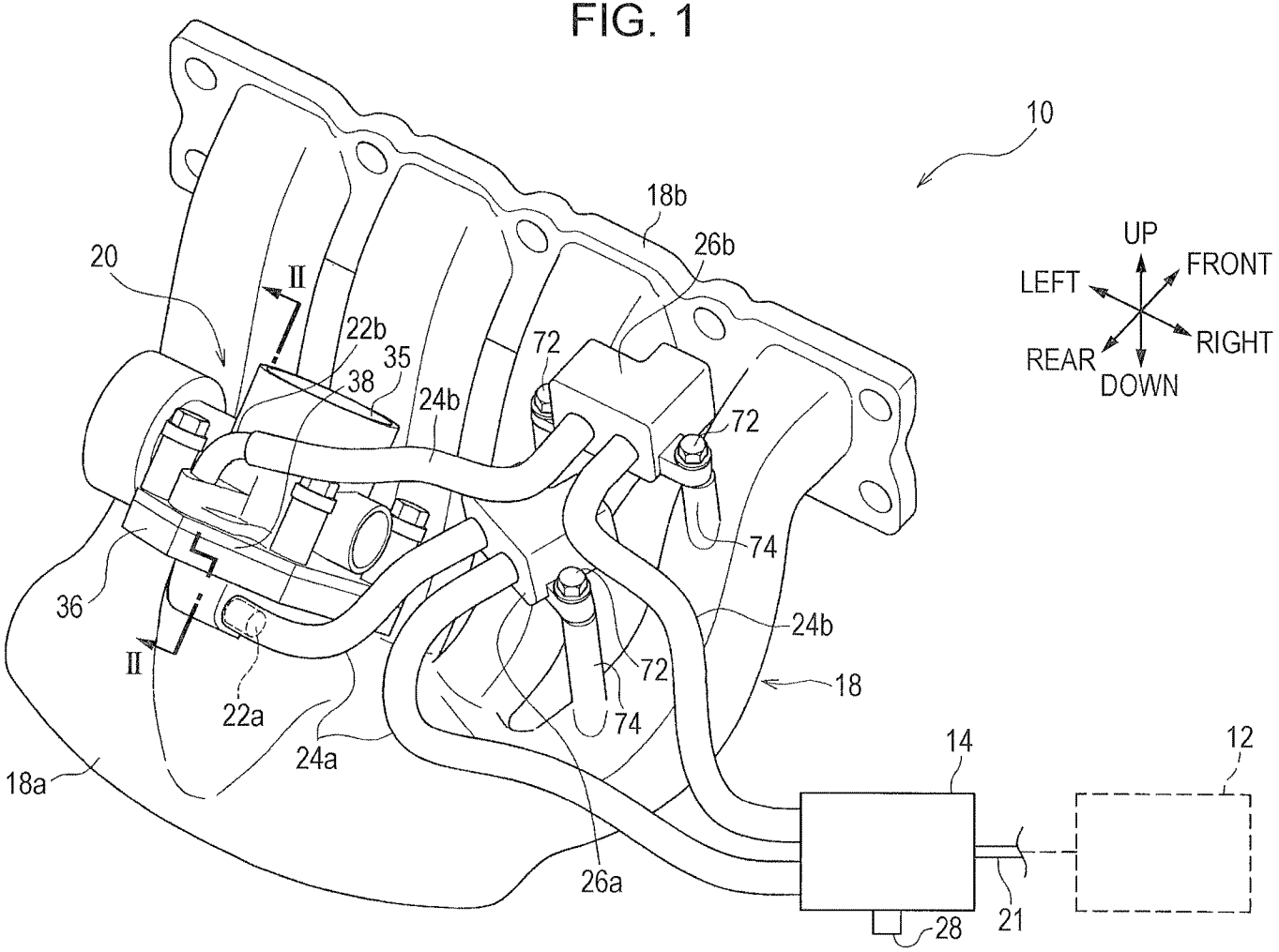
FIG. 1 is a schematic perspective view of a vaporized-fuel processing apparatus according to an embodiment of the present disclosure.

The embodiments will now be described with reference to the accompanying drawings, wherein like reference numerals designate corresponding or identical elements throughout the various drawings.

Figure 2:
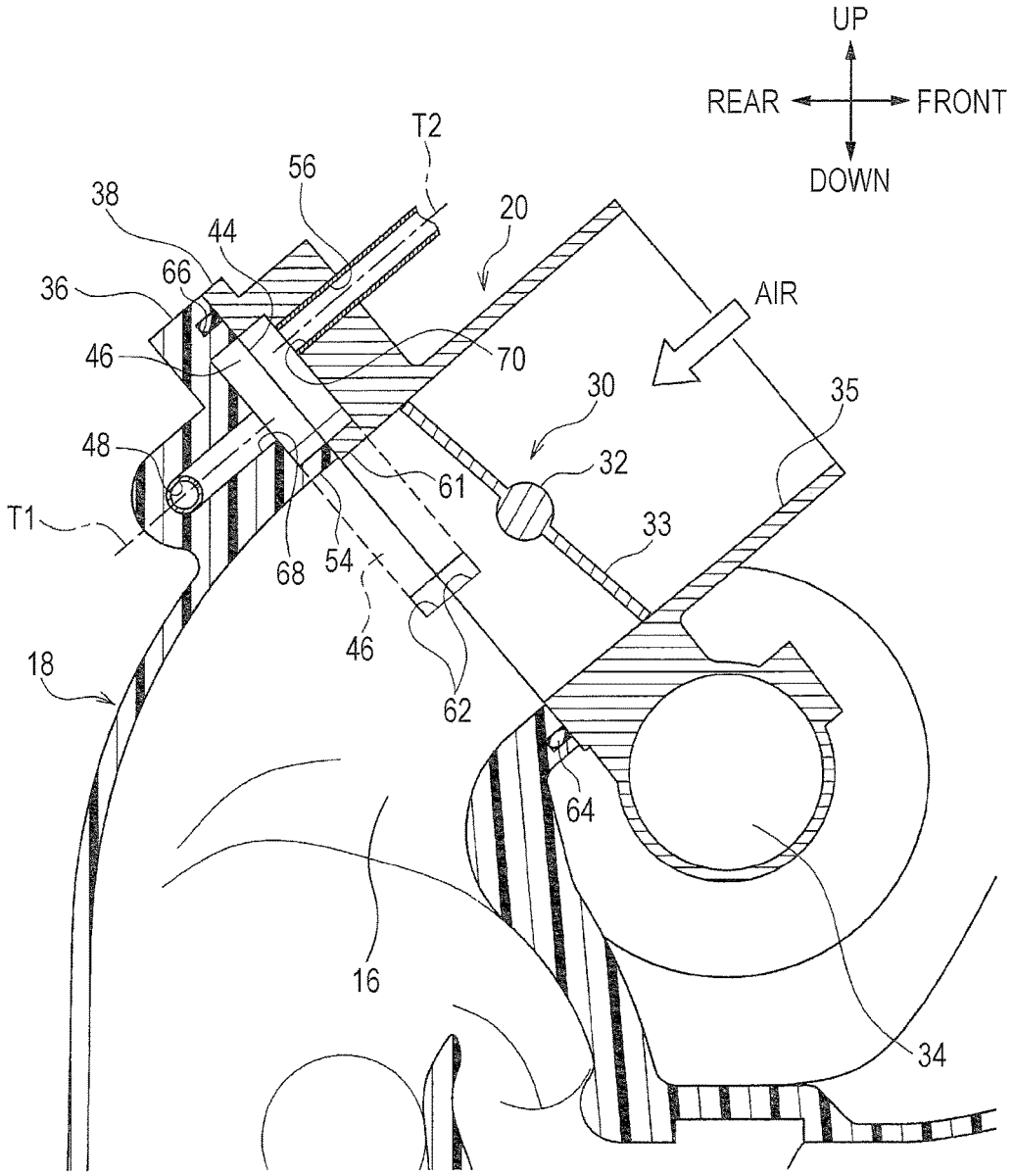
FIG. 2 is a schematic vertical sectional view taken along line II-II in FIG. 1.

FIG. 1 is a schematic perspective view of a vaporized-fuel processing apparatus according to the embodiment. FIG. 2 is a schematic vertical sectional view taken along line II-II in FIG. 1. In each of the drawings, a front-rear direction, an up-down direction, and a left-right direction denote a vehicle front-rear direction, a vehicle up-down direction, and a vehicle-width direction, respectively.

The vaporized-fuel processing apparatus according to the embodiment is particularly applied to a hybrid vehicle having both an engine (not shown) and a motor (not shown).

As shown in FIG. 1, a vaporized-fuel processing apparatus 10 includes a fuel tank 12 that stores fuel, a canister 14 that adsorbs vaporized fuel produced within the fuel tank 12, and an intake manifold 18 and a throttle body 20 that have an intake passage 16 (see FIG. 2) communicating with an internal combustion engine. A tube 21 is connected between the fuel tank 12 and the canister 14. The vaporized fuel produced within the fuel tank 12 is fed to the canister 14 via the tube 21.

Furthermore, the vaporized-fuel processing apparatus 10 includes a first purge pipe 24*a* connected between a pipe connection port (not shown) of the canister 14 and a pipe connection port 22*a* of the intake manifold 18 and functioning as a purge passage that guides the vaporized fuel adsorbed in the canister 14 toward the intake passage 16; a second purge pipe 24*b* connected between a pipe connection port (not shown) of the canister 14 and a pipe connection port 22*b* of the throttle body 20 and functioning as a purge passage that guides the vaporized fuel adsorbed in the canister 14 toward the intake passage 16; a first vaporized-fuel control valve 26*a* disposed in the first purge pipe 24*a* and having a low rated capacity; and a second vaporized-fuel control valve 26*b* disposed in the second purge pipe 24*b* and having a high rated capacity. In this embodiment, the terms "high capacity" and "low capacity" are used in terms of a relative magnitude relationship between the rated capacity of the first vaporized-fuel control valve 26*a* and the rated capacity of the second vaporized-fuel control valve 26*b*.

A fuel pump (not shown) that feeds the fuel stored in the fuel tank 12 toward the engine and a fuel-amount detector (e.g., a float) that detects an amount of fuel supplied to the fuel tank 12 via a filler pipe (not shown) are provided inside the fuel tank 12.

The canister 14 is filled with an adsorbent (not shown), such as active carbon. The canister 14 is provided with an ambient-air inlet 28 for introducing ambient air inside.

Each of the first vaporized-fuel control valve 26*a* and the second vaporized-fuel control valve 26*b* is a so-called purge control valve that controls the amount of vaporized fuel, adsorbed within the canister 14, to be introduced into the intake passage 16 together with air by changing the position of a valve body (e.g., a diaphragm) (not shown) disposed within the valve.

The intake manifold 18 is connected to the internal combustion engine (e.g., an inline four-cylinder engine) via a gasket (not shown). The intake manifold 18 has a surge tank 18*a* and a cylinder connection section 18*b* that branches off from the surge tank 18*a* and connects to an intake port of a cylinder head (not shown).

The throttle body 20 is provided with a throttle valve 30 that opens and closes the intake passage 16 in response to a detection signal from an accelerator-position sensor (not shown) (see FIG. 2). The throttle valve 30 includes a shaft 32 that is rotatably supported within the intake passage 16, a disk 33 that rotates about the shaft 32 integrally with the shaft 32 by a predetermined angle, and an actuator 34 that rotationally drives the shaft 32 in a predetermined direction. The shaft 32 and the disk 33 constitute a commonly-known butterfly valve. The throttle body 20 is connected to a pipe (not shown) and is provided with, for example, an air supply port 35 that is supplied with air from an air cleaner.

A flange 36 (see FIG. 3) and a flange 38 (see FIG. 4) are provided at the connection area between the intake manifold 18 and the throttle body 20. The flange 36 is integrated with the intake manifold 18 and substantially has a rectangular shape in plan view. The flange 38 is integrated with the throttle body 20 and substantially has a rectangular shape in plan view. The flanges 36 and 38 are joined to each other by inserting multiple (e.g., four) bolts 42 through bolt through-holes 40 formed at the four corners of the flanges 36 and 38.

Figure 3:
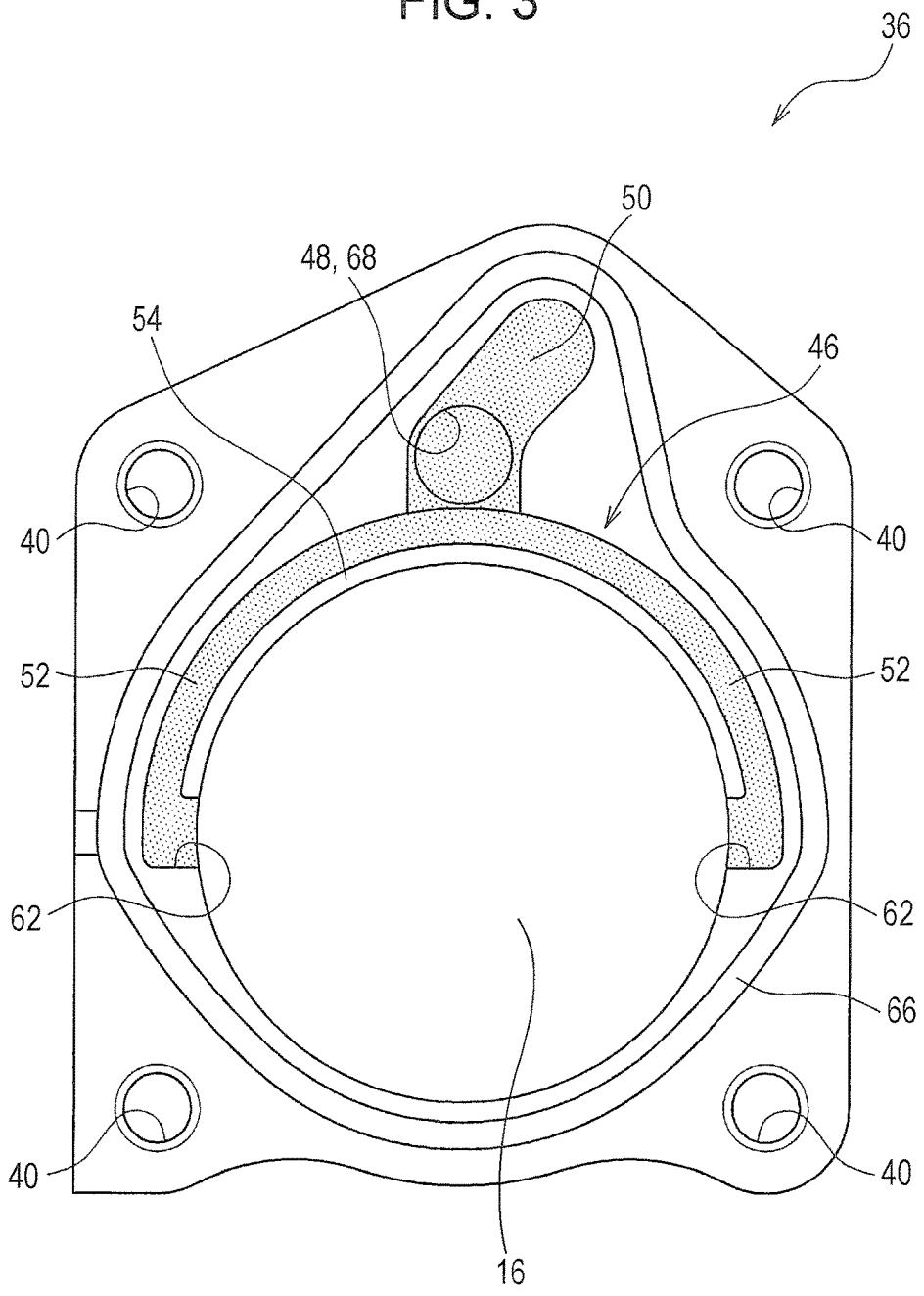
FIG. 3 is a plan view of a flange of an intake manifold.

As shown in FIG. 2, a chamber 46 that communicates with the intake passage 16 is provided at an abutment plane 44 between the flange 36 of the intake manifold 18 and the flange 38 of the throttle body 20. As shown in FIG. 3, the flange 36 of the intake manifold 18 is provided with a first purge guide hole 48, a communication recess 50, and a circular-arc-shaped recess 52. The first purge guide hole 48 is connected to and is in communication with the first purge pipe 24*a* (see FIG. 1) and guides the vaporized fuel adsorbed in the canister 14 toward the chamber 46. The communication recess 50 communicates with the first purge guide hole 48 and extends crookedly in a substantially L-shape. The circular-arc-shaped recess 52 continues from a lower end of the communication recess 50 and extends along the semi-circumference of the intake passage 16. A partition 54 that curves in a circular-arc shape is provided between the circular-arc-shaped recess 52 and the intake passage 16.

Figure 4:
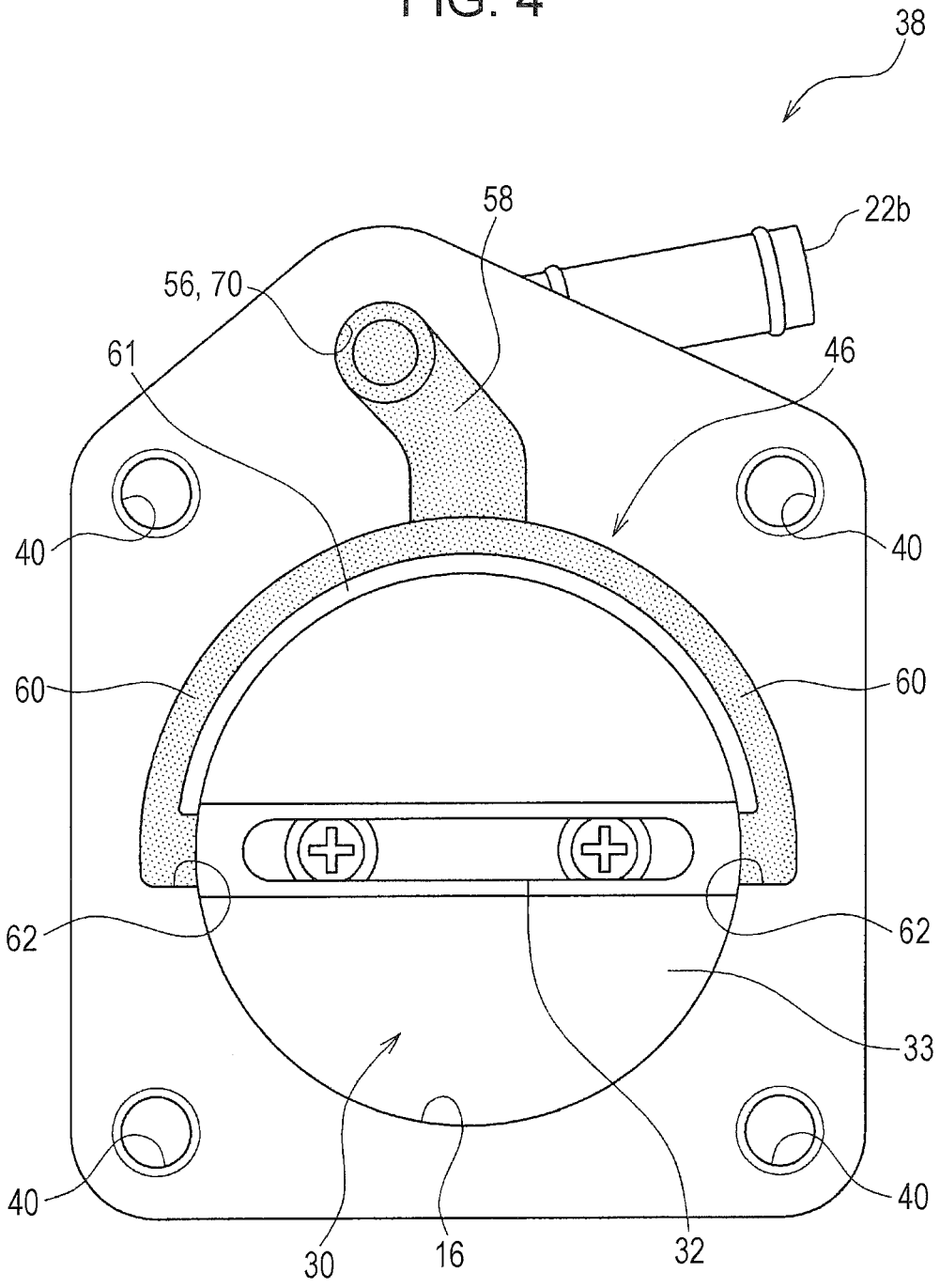
FIG. 4 is a plan view of a flange of a throttle body.
Figure 5:
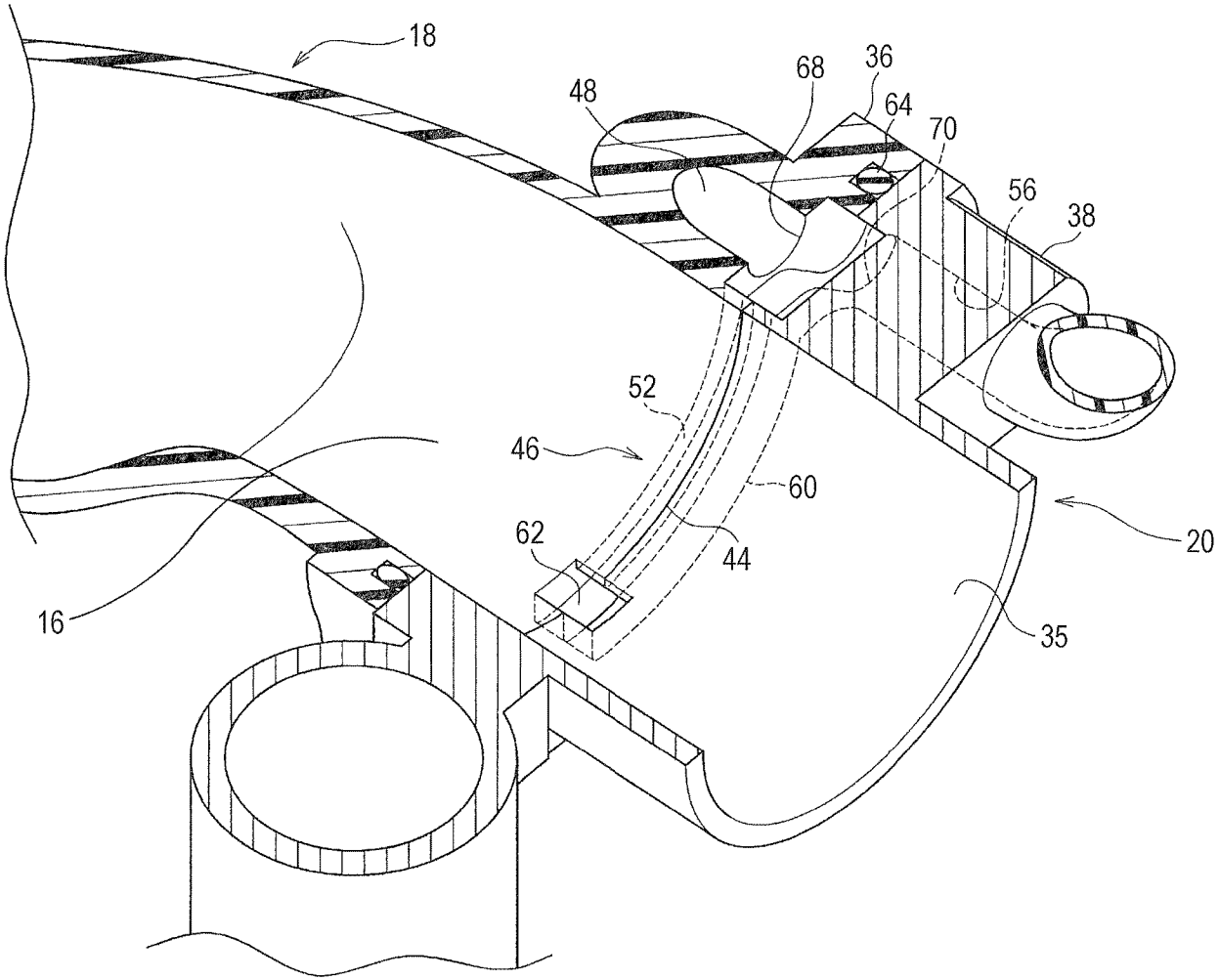
FIG. 5 is a cutaway perspective view of an abutment plane between the intake manifold and the throttle body.

As shown in FIG. 4, the flange 38 of the throttle body 20 is provided with a second purge guide hole 56, a communication recess 58, and a circular-arc-shaped recess 60. The second purge guide hole 56 is connected to and is in communication with the second purge pipe 24*b* (see FIG. 1) and guides the vaporized fuel adsorbed in the canister 14 toward the chamber 46. The communication recess 58 communicates with the second purge guide hole 56 and extends crookedly in a substantially L-shape. The circular-arc-shaped recess 60 continues from a lower end of the communication recess 58 and extends along the semi-circumference of the intake passage 16. A partition 61 that curves in a circular-arc shape is provided between the circular-arc-shaped recess 60 and the intake passage 16.

Figure 6:
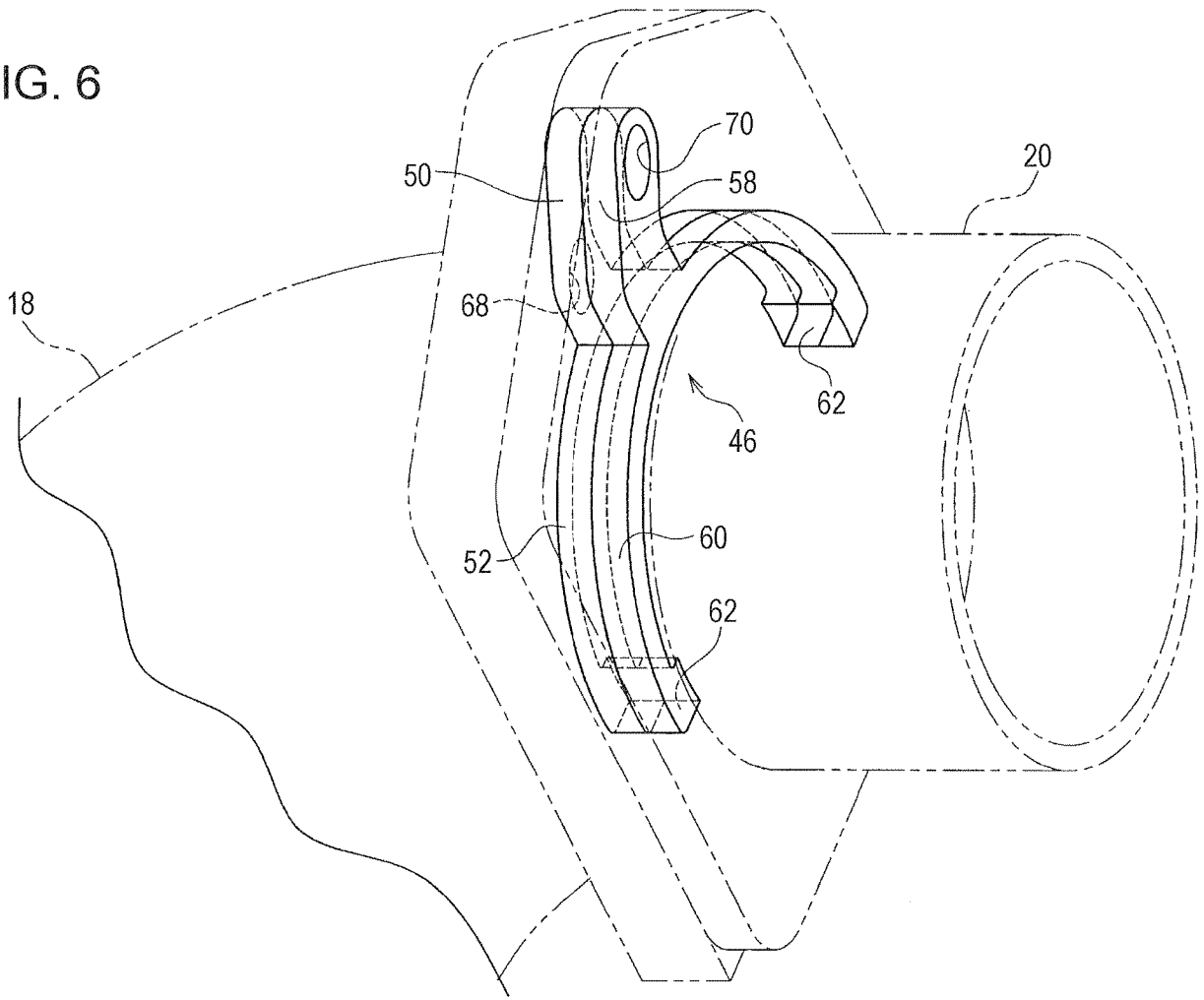
FIG. 6 is a transparent perspective view in which a chamber provided at the abutment plane is indicated by a solid line.

In this case, the communication recess 50 and the circular-arc-shaped recess 52 in the intake manifold 18 and the communication recess 58 and the circular-arc-shaped recess 60 in the throttle body 20 are symmetrically arranged (i.e., mirror arrangement) (see and compare FIG. 3 and FIG. 4). By joining the intake manifold 18 and the throttle body 20 at the abutment plane 44, the communication recesses 50 and 58 facing each other and the circular-arc-shaped recesses 52 and 60 facing each other form the chamber 46. As indicated by a solid line in FIG. 6, the chamber 46 is formed by the communication recesses 50 and 58 facing each other and the circular-arc-shaped recesses 52 and 60 facing each other so that a desired capacity can be ensured.

The terminal ends (i.e., lower ends) of each of the circular-arc-shaped recesses 52 and 60 are provided with a pair of ports 62 that supply the vaporized fuel toward the intake passage 16 in the radially-inward direction thereof (see FIG. 2 to FIG. 6). The terminal ends of the circular-arc-shaped recesses 52 and 60 are not provided with the partitions 54 and 61 that separate the circular-arc-shaped recesses 52 and 60 from the intake passage 16. Instead, the ports 62 are disposed facing each other toward the center of the intake passage 16.

Furthermore, the flange 36 of the intake manifold 18 has a seal groove 66 having a shape that surrounds the chamber 46 and provided for fitting a seal member 64 therein. The flange 38 of the throttle body 20 has a flat surface that covers this seal groove 66 (see FIG. 2 to FIG. 4). By fitting the seal member 64 (e.g., an O-ring) into the seal groove 66 and joining the intake manifold 18 and the throttle body 20 at the abutment plane 44, the seal member 64 becomes pressed and deformed, whereby the chamber 46 is hermetically sealed.

As shown in FIG. 2, the first purge guide hole 48 in the intake manifold 18 has an opening 68 that faces the chamber 46. The second purge guide hole 56 in the throttle body 20 has an opening 70 that faces the chamber 46. The opening 68 in the intake manifold 18 and the opening 70 in the throttle body 20 are positionally offset from each other within the respective communication recesses 50 and 58 of the chamber 46.

Specifically, the opening 68 of the first purge guide hole 48 in the intake manifold 18 is formed in an area at the lower side of the communication recesses 50 and 58 and near the intake passage 16. On the other hand, the opening 70 of the second purge guide hole 56 in the throttle body 20 is formed in an area at the upper side of the communication recesses 50 and 58 and away from the intake passage 16 relative to the opening 68. Moreover, an axis T1 extending through the center of the opening 68 of the first purge guide hole 48 is not aligned with an axis T2 extending through the center of the opening 70 of the second purge guide hole 56.

The first purge pipe 24*a* and the second purge pipe 24*b* are respectively provided with the first and second vaporized-fuel control valves 26*a* and 26*b* with different rated capacities (see FIG. 1). The first vaporized-fuel control valve 26*a* with a low rated capacity (e.g., 50 L/min) communicates with the first purge guide hole 48 in the intake manifold 18. The second vaporized-fuel control valve 26*b* with a high rated capacity (e.g., 100 L/min) communicates with the second purge guide hole 56 in the throttle body 20. Specifically, the first purge guide hole 48 communicating with the low-capacity first vaporized-fuel control valve 26*a* opens toward the chamber 46 at a position closer to the intake passage 16 than the second purge guide hole 56 communicating with the high-capacity second vaporized-fuel control valve 26*b* (see FIG. 2).

The first and second vaporized-fuel control valves 26*a* and 26*b* are fixed to protrusions 74, which protrude upward from the intake manifold 18, by using bolts 72 (see FIG. 1).

The vaporized-fuel processing apparatus 10 according to this embodiment basically has the above-described configuration. Next, the advantages of the vaporized-fuel processing apparatus 10 will be described.

Figure 7:
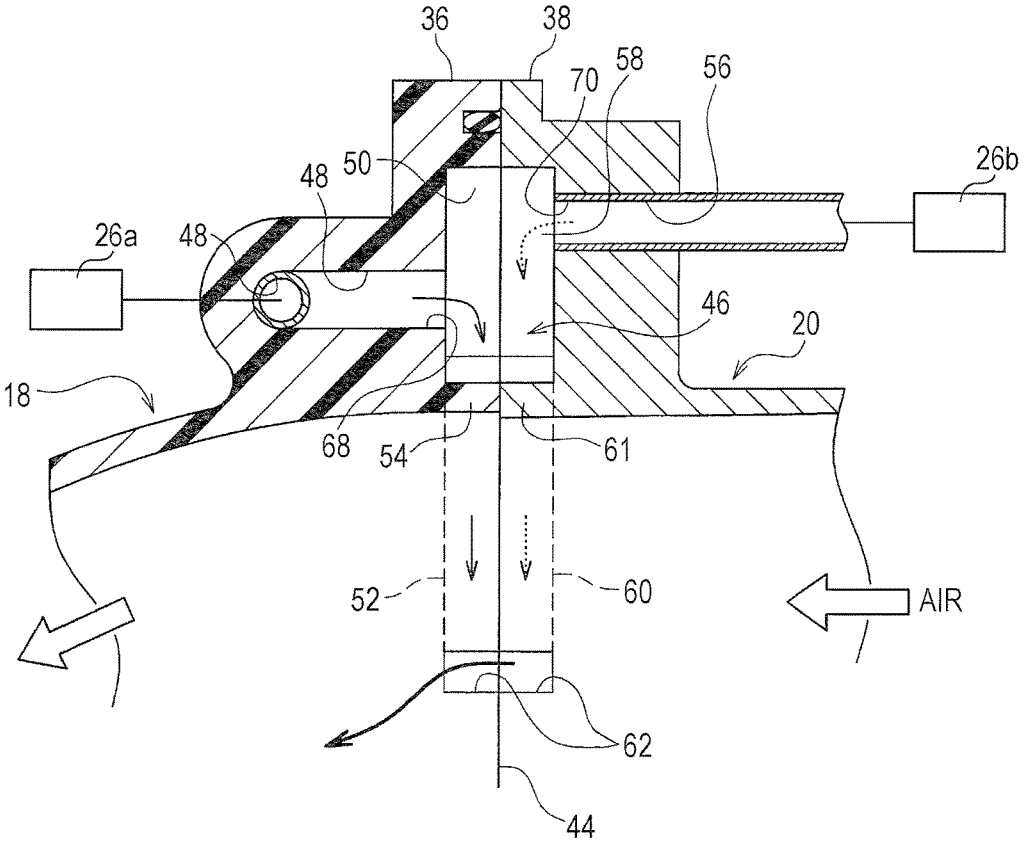
FIG. 7 illustrates how vaporized fuel introduced into the chamber from a first purge guide hole and vaporized fuel introduced into the chamber from a second purge guide hole mix with each other.

As shown in FIG. 7, the vaporized fuel adsorbed in the canister 14 is introduced into the chamber 46 formed at the abutment plane 44 from the first purge guide hole 48 in the intake manifold 18 via the first purge pipe 24*a*, and is also introduced into the same chamber 46 formed at the abutment plane 44 from the second purge guide hole 56 in the throttle body 20 via the second purge pipe 24*b*. The vaporized fuel introduced from the first purge guide hole 48 and the vaporized fuel introduced from the second purge guide hole 56 travel along the communication recesses 50 and 58 and the circular-arc-shaped recesses 52 and 60 that constitute the single chamber 46, and mix with each other so as to become homogenized. The mixed vaporized fuel is suctioned toward the center of the intake passage 16 from the pairs of ports 62 provided at the lower ends of the circular-arc-shaped recesses 52 and 60 and mixes with an air-fuel mixture flowing through the intake passage 16 before being fed toward the engine.

In this embodiment, the vaporized fuel adsorbed in the canister 14 can be collectively introduced from the two purge guide holes 48 and 56 in the intake manifold 18 and the throttle body 20 to the single chamber 46 disposed at the abutment plane 44 between the intake manifold 18 and the throttle body 20 before the vaporized fuel is introduced into the intake passage 16. Therefore, in this embodiment, the vaporized fuel can be introduced into the intake passage 16 after the vaporized fuel from the first purge guide hole 48 and the vaporized fuel from the second purge guide hole 56 are efficiently mixed within the same chamber 46, whereby the fuel can be homogenized.

Furthermore, in this embodiment, since the chamber 46 is disposed at the abutment plane 44, which is where the vaporized fuel can mix with the air-fuel mixture (i.e., intake air) most readily, between the intake manifold 18 and the throttle body 20, the vaporized fuel from the first purge guide hole 48 and the vaporized fuel from the second purge guide hole 56 can be mixed within the same chamber 46 even more efficiently, whereby the fuel can be homogenized.

Furthermore, in this embodiment, the opening 68 of the first purge guide hole 48 in the intake manifold 18 and the opening 70 of the second purge guide hole 56 in the throttle body 20 are positionally offset from each other (see FIG. 2). By positionally offsetting the two openings 68 and 70 in this manner, for example, the flow of the vaporized fuel introduced to the chamber 46 from the opening 68 and the flow of the vaporized fuel introduced to the chamber 46 from the opening 70 are prevented from interfering with each other, and a backflow from one of the openings toward the other opening can be properly avoided.

Furthermore, in this embodiment, the first purge guide hole 48 communicating with the low-rated-capacity first vaporized-fuel control valve 26*a* opens toward the chamber 46 at a position closer to the intake passage 16 than the second purge guide hole 56 communicating with the high-rated-capacity second vaporized-fuel control valve 26*b* (see FIG. 7). Consequently, in this embodiment, the vaporized fuel introduced from the first purge guide hole 48 communicating with the low-rated-capacity first vaporized-fuel control valve 26*a* can be prevented from adhering to the valve body (not shown) of the high-rated-capacity second vaporized-fuel control valve 26*b*.

Next, a relationship with regard to usage frequencies of the two vaporized-fuel control valves will be described with reference to FIG. 8A to FIG. 8B.

FIG. 8A to FIG. 8D are timing charts showing examples of multiple operation patterns of the first vaporized-fuel control valve 26*a* and the second vaporized-fuel control valve 26*b* in accordance with increasing requested flow rate. In first to fourth operation patterns, the usage frequency of the low-capacity first vaporized-fuel control valve 26*a* is set to be high, whereas the usage frequency of the high-capacity second vaporized-fuel control valve 26*b* is set to be low.

Figures 8A, 8B, 8C, 8D:
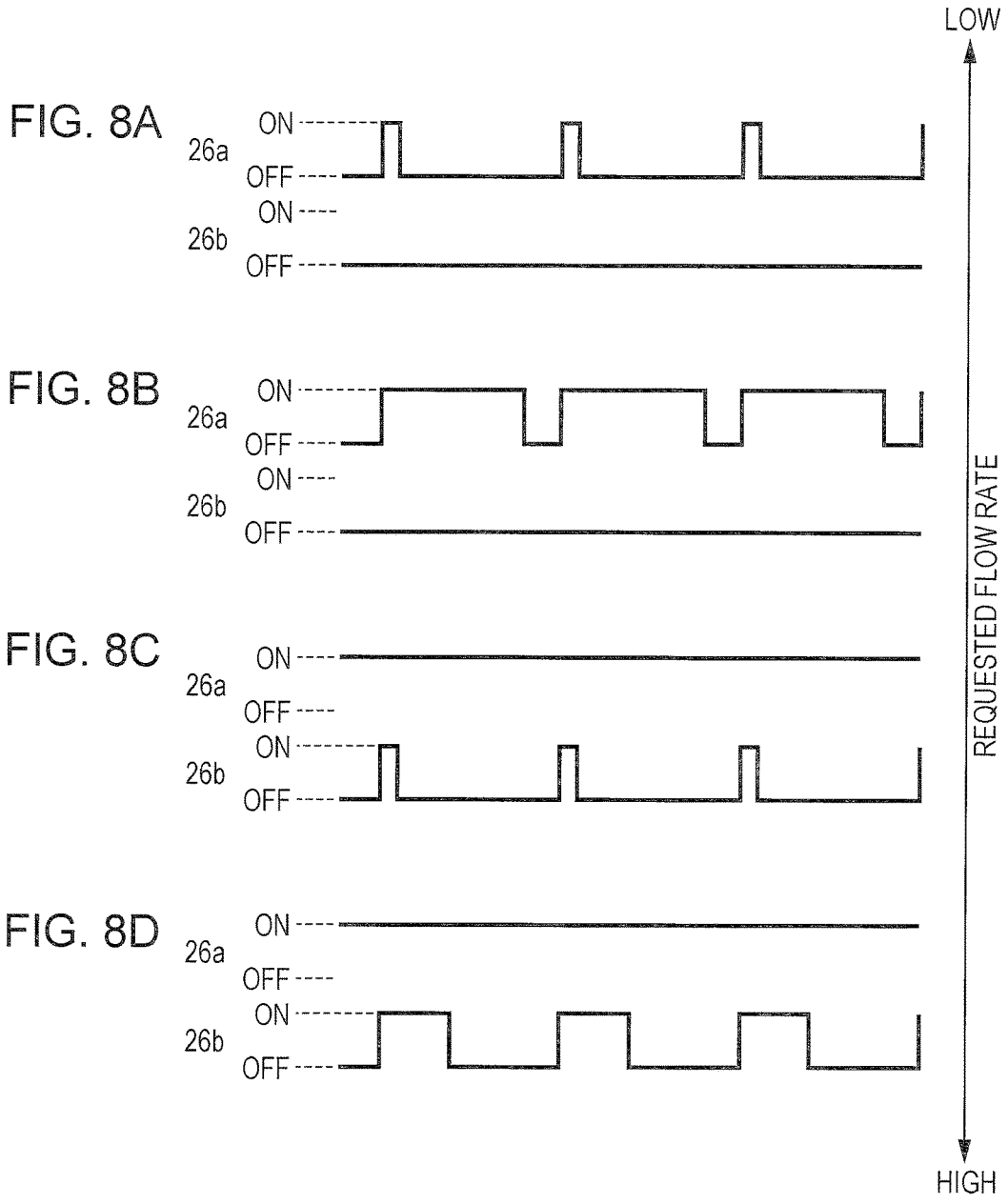
FIG. 8A to FIG. 8D are timing charts showing examples of multiple operation patterns of a first vaporized-fuel control valve and a second vaporized-fuel control valve in accordance with increasing requested flow rate.

Referring to FIG. 8A, in the first operation pattern corresponding to the lowest requested flow rate, the first vaporized-fuel control valve 26*a* is switched from an OFF state to an ON state in response to a rectangular pulse signal having a relatively short pulse width, whereas the second vaporized-fuel control valve 26*b* is maintained in an OFF state.

Referring to FIG. 8B, in the second operation pattern in which the requested flow rate is increased from that in the first operation pattern, the first vaporized-fuel control valve 26*a* is switched from an OFF state to an ON state in response to a rectangular pulse signal having a relatively long pulse width, whereas the second vaporized-fuel control valve 26*b* is maintained in an OFF state.

Referring to FIG. 8C, in the third operation pattern in which the requested flow rate is increased from that in the second operation pattern, the first vaporized-fuel control valve 26*a* is maintained in an ON state, while the second vaporized-fuel control valve 26*b* is switched from an OFF state to an ON state in response to a rectangular pulse signal having a relatively short pulse width.

Referring to FIG. 8D, in the fourth operation pattern in which the requested flow rate is increased from that in the third operation pattern, the first vaporized-fuel control valve 26*a* is maintained in an ON state, while the second vaporized-fuel control valve 26*b* is switched from an OFF state to an ON state in response to a rectangular pulse signal having a relatively long pulse width.

In this embodiment, the first purge guide hole 48 communicating with the first vaporized-fuel control valve 26*a* with the high usage frequency opens toward the chamber 46 at a position closer to the intake passage 16 than the second purge guide hole 56 communicating with the second vaporized-fuel control valve 26*b* with the low usage frequency. Consequently, in this embodiment, the vaporized fuel introduced from the first purge guide hole 48 communicating with the first vaporized-fuel control valve 26*a* with the relatively high usage frequency can be prevented from adhering to the valve body (not shown) of the second vaporized-fuel control valve 26*b* with the relatively low usage frequency.

In detail, the second vaporized-fuel control valve 26*b* with the relatively low usage frequency is disposed away from the intake passage 16 relative to the first vaporized-fuel control valve 26*a* with the relatively high usage frequency so that the vaporized fuel introduced from the second vaporized-fuel control valve 26*b* is less likely to flow into the first vaporized-fuel control valve 26*a*. Therefore, the vaporized fuel can be prevented from adhering to the valve body of the first vaporized-fuel control valve 26*a* formed of, for example, a diaphragm, thereby reducing a failure of the first vaporized-fuel control valve 26*a*. As an alternative to the above description, the usage frequency of the high-capacity second vaporized-fuel control valve 26*b* may be set to be high, and the usage frequency of the low-capacity first vaporized-fuel control valve 26*a* may be set to be low.

Furthermore, in this embodiment, for example, the driving cycles for the first vaporized-fuel control valve 26*a* and the second vaporized-fuel control valve 26*b* may be set identical to each other. In this case, when the two control valves are to be driven simultaneously, the activation timing of the driving cycle for the second vaporized-fuel control valve 26*b* may be deviated (retarded) from the activation timing of the driving cycle for the first vaporized-fuel control valve 26*a* by a predetermined phase. By deviating the phases in this manner, the mixed vaporized fuel can be homogenized, and pulsation of the mixed vaporized fuel can be suppressed.

In this case, for example, by driving the low-capacity first vaporized-fuel control valve 26*a* alone with minimal drive duty, a change in the flow rate at the time of first activation can be suppressed.

Generally, in a hybrid vehicle, the driving of the engine is limited, and the number of times the vaporized fuel is introduced into the intake passage 16 is fewer than that in a gasoline-type vehicle. Therefore, a large amount of vaporized fuel is stored in the canister 14. In order to suction this large amount of vaporized fuel toward the intake passage 16, a large-size vaporized-fuel control valve (not shown) is necessary. The use of such a large-size vaporized-fuel control valve leads to a significant change in the flow rate when starting the introduction of the vaporized fuel, thus resulting in increased fluctuations of the air-fuel ratio.

In this embodiment, two small-size vaporized-fuel control valves, that is, the first and second vaporized-fuel control valves 26*a* and 26*b*, are arranged in parallel with each other without using a large-size vaporized-fuel control valve, thereby suppressing fluctuations of the air-fuel ratio when starting the introduction of the vaporized fuel.

Although the vaporized-fuel processing apparatus 10 is applied to a hybrid vehicle in this embodiment, the vaporized-fuel processing apparatus 10 is not limited to a hybrid vehicle and may also be applied to, for example, a vehicle driven by an engine alone.

According to an aspect of the embodiment, a vaporized-fuel processing apparatus includes an intake passage that is formed by an intake manifold and a throttle body; a chamber that communicates with the intake passage; a first purge guide hole that guides vaporized fuel adsorbed in a canister toward the chamber; and a second purge guide hole that guides the vaporized fuel adsorbed in the canister toward the chamber.

According to the above aspect of the embodiment, the vaporized fuel adsorbed in the canister is collectively introduced into the same chamber from the two purge guide holes before the vaporized fuel is introduced into the intake passage. Therefore, in the above aspect of the embodiment, the vaporized fuel can be introduced into the intake passage after the vaporized fuel from the first purge guide hole and the vaporized fuel from the second purge guide hole are efficiently mixed within the same chamber, whereby the fuel can be homogenized.

In the above aspect of the embodiment, the chamber may be formed at an abutment plane between the intake manifold and the throttle body. The first purge guide hole may be formed in the intake manifold, and the second purge guide hole may be formed in the throttle body.

Accordingly, the vaporized fuel can be collectively introduced to the chamber disposed at the abutment plane between the intake manifold and the throttle body from both the intake manifold side and the throttle body side. Consequently, since the chamber is disposed at the abutment plane, which is where the vaporized fuel can mix with intake air most readily, the vaporized fuel from the first purge guide hole and the vaporized fuel from the second purge guide hole can be mixed within the same chamber even more efficiently, whereby the fuel can be homogenized.

Furthermore, in the above aspect of the embodiment, the first purge guide hole in the intake manifold preferably has an opening that faces the chamber, and the second purge guide hole in the throttle body preferably has an opening that faces the chamber. The opening in the intake manifold and the opening in the throttle body may be positionally offset from each other.

Accordingly, by positionally offsetting the opening in the intake manifold and the opening in the throttle body from each other, for example, the flow of the vaporized fuel introduced to the chamber from one of the openings and the flow of the vaporized fuel introduced to the chamber from the other opening are prevented from interfering with each other, and a backflow from one of the openings toward the other opening can be properly avoided.

Furthermore, the vaporized-fuel processing apparatus according to the above aspect of the embodiment may further include two vaporized-fuel control valves with different usage frequencies. Of the first purge guide hole in the intake manifold and the second purge guide hole in the throttle body, the purge guide hole that communicates with the vaporized-fuel control valve with the higher usage frequency preferably opens toward the chamber at a position closer to the intake passage than the purge guide hole that communicates with the vaporized-fuel control valve with the lower usage frequency.

Accordingly, the vaporized fuel introduced from the purge guide hole that communicates with the vaporized-fuel control valve with the relatively high usage frequency can be prevented from adhering to a valve body of the vaporized-fuel control valve with the relatively low usage frequency.

Furthermore, the vaporized-fuel processing apparatus according to the above aspect of the embodiment may further include two vaporized-fuel control valves with different rated capacities. Of the first purge guide hole in the intake manifold and the second purge guide hole in the throttle body, the purge guide hole that communicates with the vaporized-fuel control valve with the lower rated capacity preferably opens toward the chamber at a position closer to the intake passage than the purge guide hole that communicates with the vaporized-fuel control valve with the higher rated capacity.

Accordingly, the vaporized fuel introduced from the purge guide hole that communicates with the vaporized-fuel control valve with the lower rated capacity can be prevented from adhering to a valve body of the vaporized-fuel control valve with the higher rated capacity.

Accordingly, the embodiment of the present application can provide a vaporized-fuel processing apparatus that facilitates mixing of vaporized fuel even when the apparatus is provided with two purge guide holes through which the vaporized fuel is introduced into the intake passage.

Obviously, numerous modifications and variations of the present invention are possible in light of the above teachings. It is therefore to be understood that within the scope of the appended claims, the invention may be practiced otherwise than as specifically described herein.

What is claimed is:

1. A vaporized-fuel processing apparatus comprising:

an intake passage that is defined by an intake manifold and a throttle body;

a chamber that communicates with the intake passage;

a first purge guide hole in the intake manifold to guide vaporized fuel adsorbed in a canister toward the chamber; and a second purge guide hole in the throttle body to guide the vaporized fuel adsorbed in the canister toward the chamber, wherein the chamber is disposed downstream of the first purge guide hole and the second purge guide hole and upstream of the intake passage in a flow direction of the vaporized fuel from the canister toward the chamber to mix the vaporized fuel after the vaporized fuel exits from the first purge guide hole and the second purge guide hole and before the vaporized fuel enters the intake passage, wherein the chamber extends within the intake manifold and within the throttle body from the first purge guide hole and the second purge guide hole to a port that provides an interface between the chamber and the intake passage, and wherein the chamber is defined at an abutment plane between the intake manifold and the throttle body.

2. The vaporized-fuel processing apparatus according to claim 1, wherein the chamber includes a first circular-arc-shaped recess provided in the intake manifold to communicate with the first purge guide hole, and a second circular-arc-shaped recess provided in the throttle body to communicate with the second purge guide hole, the second circular-arc-shaped recess facing the first circular-arc-shaped recess.

3. The vaporized-fuel processing apparatus according to claim 1, wherein the first purge guide hole in the intake manifold has a first opening that faces the chamber, wherein the second purge guide hole in the throttle body has a second opening that faces the chamber, and wherein the first opening in the intake manifold and the second opening in the throttle body are positionally offset from each other.

4. The vaporized-fuel processing apparatus according to claim 3, further comprising:

a first vaporized-fuel control valve; and a second vaporized-fuel control valve with usage frequency lower than usage frequency of the first vaporized-fuel control valve, wherein one of the first purge guide hole in the intake manifold and the second purge guide hole in the throttle body communicates with the first vaporized-fuel control valve and opens toward the chamber at a position closer to the intake passage than the other of the first purge guide hole and the second purge guide hole that communicates with the second vaporized-fuel control valve.

5. The vaporized-fuel processing apparatus according to claim 3, further comprising:

a first vaporized-fuel control valve; and a second vaporized-fuel control valve with a rated capacity higher than a rated capacity of the first vaporized-fuel control valve, wherein one of the first purge guide hole in the intake manifold and the second purge guide hole in the throttle body communicates with the first vaporized-fuel control valve and opens toward the chamber at a position closer to the intake passage than the other of the first purge guide hole and the second purge guide hole that communicates with the second vaporized-fuel control valve.

6. The vaporized-fuel processing apparatus according to claim 3, further comprising:

a first vaporized-fuel control valve provided to communicate with the first purge guide hole in the intake manifold; and a second vaporized-fuel control valve provided to communicate with the second purge guide hole in the throttle body, the second vaporized-fuel control valve having usage frequency lower than usage frequency of the first vaporized-fuel control valve, wherein the first purge guide hole opens toward the chamber at a position closer to the intake passage than the second purge guide hole.

7. The vaporized-fuel processing apparatus according to claim 3, further comprising:

a first vaporized-fuel control valve provided to communicate with the first purge guide hole in the intake manifold; and a second vaporized-fuel control valve provided to communicate with the second purge guide hole in the throttle body, the second vaporized-fuel control valve having a rated capacity higher than a rated capacity of the first vaporized-fuel control valve, wherein the first purge guide hole opens toward the chamber at a position closer to the intake passage than the second purge guide hole.

8. The vaporized-fuel processing apparatus according to claim 1, wherein the first purge guide hole is disposed in a flange of the intake manifold and the second purge guide hole is disposed in a flange of the throttle body.

9. The vaporized-fuel processing apparatus according to claim 1, wherein the first purge guide hole is fluidly connected between the canister and the chamber, and wherein the second purge guide hole is fluidly connected between the canister and the chamber.

10. The vaporized-fuel processing apparatus according to claim 1, wherein the chamber is defined at an abutment plane disposed between the intake manifold and the throttle body and orthogonal to the intake passage.

11. The vaporized-fuel processing apparatus according to claim 1, wherein the port is disposed on the intake passage at a location facing toward an interior of the intake passage, the port disposed at an end of the chamber.

12. The vaporized-fuel processing apparatus according to claim 11, wherein the chamber extends in a circumferential direction around the intake passage, and the port is disposed radially inward of the chamber toward a center of the intake passage.

13. A vaporized-fuel processing apparatus comprising:

an intake passage that is defined by an intake manifold and a throttle body;

a chamber that communicates with the intake passage, the chamber including:

a first recess provided in a flange of the intake manifold to communicate with a first purge guide hole; and a second recess provided in a flange of the throttle body to communicate with a second purge guide hole, the first purge guide hole is disposed in the intake manifold to guide vaporized fuel adsorbed in a canister toward the chamber, the second purge guide hole is disposed in the throttle body to guide the vaporized fuel adsorbed in the canister toward the chamber, the chamber extends within the intake manifold and within the throttle body from the first purge guide hole and the second purge guide hole to a port that provides an interface between the chamber and the intake passage, and the chamber is defined at an abutment plane between the intake manifold and the throttle body, wherein the chamber is configured to mix the vaporized fuel after the vaporized fuel exits from the first purge guide hole and the second purge guide hole and before the vaporized fuel enters the intake passage.

14. The vaporized-fuel processing apparatus according to claim 1, wherein the first purge guide hole and the second purge guide hole are each spaced from the port in a circumferential direction of the intake passage.

15. The vaporized-fuel processing apparatus according to claim 14, further comprising a second port that provides an interface between the chamber and the intake passage disposed at a second end of the chamber, wherein the port is a first port disposed at a first end of the chamber.

16. The vaporized-fuel processing apparatus according to claim 13, wherein the first purge guide hole and the second purge guide hole are each spaced from the port in a circumferential direction of the intake passage.

17. The vaporized-fuel processing apparatus according to claim 16, further comprising a second port that provides an interface between the chamber and the intake passage disposed at a second end of the chamber, wherein the port is a first port disposed at a first end of the chamber.

18. The vaporized-fuel processing apparatus according to claim 1, wherein the abutment plane is defined at a portion of the intake manifold that is in direct contact with a portion of the throttle body, and wherein the chamber and the abutment plane extend within a flange of the intake manifold and a flange of the throttle body.

19. The vaporized-fuel processing apparatus according to claim 13, wherein the abutment plane is defined at a portion of the intake manifold that is in direct contact with a portion of the throttle body, and wherein the chamber and the abutment plane extend within the flange of the intake manifold and the flange of the throttle body.

* * * * *